US008565665B2

(12) United States Patent
Shono

(10) Patent No.: US 8,565,665 B2
(45) Date of Patent: Oct. 22, 2013

(54) IMAGE FORMING APPARATUS AND COVER SHEET CONVEYANCE SYSTEM INCORPORATED THEREIN

(75) Inventor: Hidekazu Shono, Hyogo-ken (JP)

(73) Assignee: Ricoh Company, Ltd., Tokyo (JP)

( * ) Notice: Subject to any disclaimer, the term of this patent is extended or adjusted under 35 U.S.C. 154(b) by 309 days.

(21) Appl. No.: 12/929,080

(22) Filed: Dec. 29, 2010

(65) Prior Publication Data

US 2011/0164903 A1 Jul. 7, 2011

(30) Foreign Application Priority Data

Jan. 6, 2010 (JP) ..... 2010-001252

(51) Int. Cl.
*G03G 15/20* (2006.01)

(52) U.S. Cl.
USPC ..... 399/400; 399/122; 399/320

(58) Field of Classification Search
USPC ..... 399/400
See application file for complete search history.

(56) References Cited

U.S. PATENT DOCUMENTS

| | | | | |
|---|---|---|---|---|
| 5,153,656 | A * | 10/1992 | Johnson et al. | 399/303 |
| 5,155,536 | A * | 10/1992 | Johnson et al. | 399/329 |
| 5,196,894 | A * | 3/1993 | Merle et al. | 399/328 |
| 5,339,146 | A * | 8/1994 | Aslam et al. | 430/47.5 |
| 5,339,148 | A * | 8/1994 | Johnson et al. | 399/341 |
| 7,551,868 | B2 * | 6/2009 | Yasutomi et al. | 399/67 |
| 7,787,815 | B2 * | 8/2010 | Nakamura et al. | 399/341 |
| 2007/0147893 | A1 | 6/2007 | Nakatake et al. | |
| 2008/0013975 | A1 * | 1/2008 | Yasutomi et al. | 399/67 |
| 2008/0056784 | A1 * | 3/2008 | Nakamura et al. | 399/341 |
| 2008/0056785 | A1 * | 3/2008 | Maruyama et al. | 399/342 |
| 2008/0131162 | A1 | 6/2008 | Nakatake et al. | |
| 2008/0310896 | A1 | 12/2008 | Shono et al. | |
| 2009/0041491 | A1 | 2/2009 | Shono et al. | |
| 2010/0266304 | A1 | 10/2010 | Inoue et al. | |
| 2011/0013958 | A1 | 1/2011 | Shono et al. | |

FOREIGN PATENT DOCUMENTS

| | | | |
|---|---|---|---|
| JP | 48-094438 | A | 12/1973 |
| JP | 02103579 | A * | 4/1990 |
| JP | 02103580 | A * | 4/1990 |
| JP | 02-158781 | A | 6/1990 |
| JP | 07005782 | A * | 1/1995 |
| JP | 2008-020520 | A | 1/2008 |
| JP | 2008-051857 | A | 3/2008 |
| JP | 2008-064804 | A | 3/2008 |
| JP | 2010-156756 | A | 7/2010 |

* cited by examiner

*Primary Examiner* — Daniel J Colilla
*Assistant Examiner* — Nguyen Q Ha
(74) *Attorney, Agent, or Firm* — Harness, Dickey & Pierce, P.L.C.

(57) ABSTRACT

An image forming apparatus includes a first pair of rotary members pressing against each other, forming a first nip therebetween, a cover sheet supply unit to transport to the first nip a cover sheet to be superimposed on an imaging surface of a recording medium, a separation unit that separates the cover sheet from the recording medium after the recording medium passes through the first nip and includes a second pair of rotary members pressing against each other, forming a second nip therebetween, and a drive unit to rotate the first and second pairs of rotary members in both a normal direction for transporting the cover sheet in a supply direction and a reverse direction. The first and second pairs of rotary members and the drive unit together form a cover sheet return mechanism for returning the cover sheet separated from the recording medium to the supply position.

13 Claims, 7 Drawing Sheets

IMAGE FORMING APPARATUS AND COVER SHEET CONVEYANCE SYSTEM INCORPORATED THEREIN

This patent specification is based on Japanese patent application No. 2010-001252 filed on Jan. 6, 2010 in the Japan Patent Office, the entire contents of which are incorporated by reference herein.

BACKGROUND OF THE INVENTION

1. Field of the Invention

The present invention relates to an image forming apparatus, and more particularly, to an image forming apparatus capable of forming high-gloss images efficiently.

2. Description of the Related Art

Conventional image forming apparatuses, such as printers, facsimiles, copiers, and multifunction apparatuses that print, fax, copy, and so on, generally use an electrophotographic process for image forming. In the electrophotographic process, toner is used to form images.

Further, such image forming apparatuses generally employ a fixing unit to fix the toner image formed on a recording medium by applying heat and pressure thereto at a nip formed between a heat roller and a pressure roller, as the recording medium bearing the toner image passes between the heat roller and the pressure roller.

In such a fixing unit, if resin included in the toner is melted by heat, adheres to the heat roller, and solidifies, surface asperities may be formed on the heat roller. Further, when the toner image is fixed by such a heat roller, small surface asperities may be formed also on the toner image after the fixing process. Accordingly, it is not possible to obtain smooth and high-gloss images.

To obtain such high-gloss images, many attempts have been made. For example, in some approaches, a gloss assist sheet is fed to the fixing unit to overlap an imaging surface of a recording medium so as to smooth the surface of the image after the fixing process (e.g., JP-2008-20520-A, JP-2008-51857-A).

JP-2008-64804-A describes an image forming apparatus which includes a separation unit to separate the gloss assist sheet from the recording medium after the fixing process. The separation unit includes a wedged-shape separation member. The gloss assist sheet is separated from the recording medium by introducing a top edge of the separation member into a space between the recording medium and the gloss assist sheet.

However, according to the image forming apparatus having the separation unit described in JP-2008-64804-A, when the separated gloss assist sheet is used again, it is required that a user load the gloss assist sheet in a sheet material storage unit. Accordingly, when a plurality of high-gloss images are printed successively, the number of times the user loads the gloss assist sheet in the apparatus is increased, thus increasing the time and effort required of the user.

In view of the foregoing, the inventor of the present invention recognizes that there is a need for an image forming apparatus to streamline setting of the gloss assist sheet when the gloss assist sheet is reused.

SUMMARY OF THE INVENTION

This patent specification describes an image forming apparatus that includes a first pair of rotary members pressing against each other, disposed in a conveyance path through which a recording medium is transported, a cover sheet supply unit to transport a cover sheet from a supply position to the first pair of rotary members, a separation unit disposed downstream from the first pair of rotary members in a supply direction in which the cover sheet is supplied to the first pair of rotary members, and a drive unit to rotate the first pair of rotary members and the second pair of rotary members in both a normal direction for transporting the cover sheet in the supply direction and a reverse direction reverse to the normal direction. The first pair of rotary members forms a first nip therebetween. The cover sheet is transported between an imaging surface of a recording medium and one of the rotary members and temporarily superimposed on the imaging surface of the recording medium. The separation unit separates the cover sheet from the recording medium after the recording medium passes through the first nip and includes a second pair of rotary members pressing against each other, thus forming a second nip therebetween. The first pair of rotary members, the second pair of rotary members, and the drive unit together form a cover sheet return mechanism for returning the cover sheet separated from the recording medium to the supply position.

This patent specification further describes an image forming apparatus that includes a fixing unit including a pair of fixing members pressing against each other and forming a fixing nip therebetween, a cover sheet supply unit to transport a cover sheet from a supply position to the fixing nip, a separation unit disposed downstream from the fixing unit in a supply direction in which the cover sheet is transported from the supply position, and a cover sheet return unit. The cover sheet is transported between an imaging surface of a recording medium and one of the fixing members and temporarily superimposed on the imaging surface of the recording medium. The separation unit separates the cover sheet from the recording medium after the recording medium passes through the fixing nip, and the cover sheet return unit transports the cover sheet separated from the recording medium to the supply position in a reverse direction reverse to the supply direction.

This patent specification further describes a temporary cover sheet conveyance system incorporated in the above-described image forming apparatus for returning the cover sheet temporarily superimposed on the recording medium to the supply position. The cover sheet conveyance system includes the first pair of rotary members, the cover sheet supply unit, the separation unit, and the drive unit described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
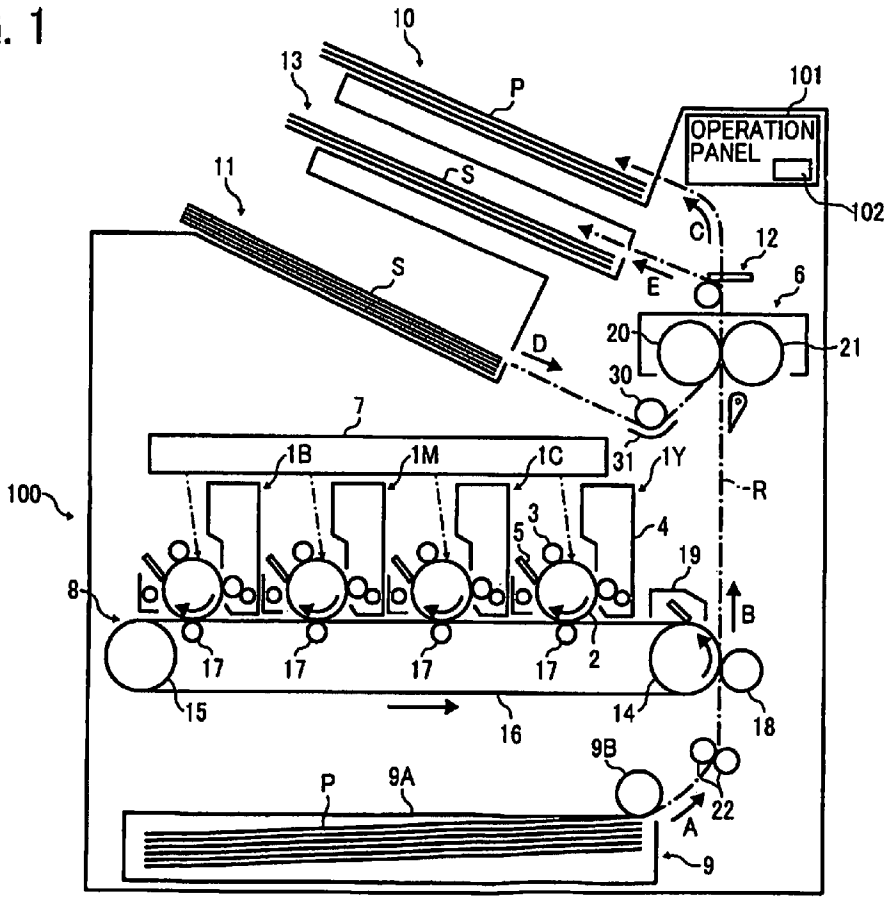
FIG. 1 is a schematic view of an example image forming apparatus according to embodiments of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, and in particular to FIG. 1, an image forming apparatus according to an embodiment of the present invention is described.

FIG. 1 is a schematic view of an illustrative example of an image forming apparatus according to the present invention. The image forming apparatus of FIG. 1 includes four process units 1Y, 1C, 1M, and 1B as image forming units which are detachably provided in a main body 100 of the image forming apparatus. It is to be noted that the suffixes Y, C, M, and B attached to each reference numeral indicate only that components indicated thereby are used for forming yellow, magenta, cyan, and black images, respectively, and hereinafter may be omitted when color discrimination is not necessary.

The process units 1Y, 1C, 1M, and 1B are essentially identical except for the color of the toner stored therein. Accordingly, a configuration of the process unit 1 is described with reference to only one of them, the process unit 1Y.

The respective process units 1 store yellow (Y), cyan (C), magenta (M), and black (K) toners corresponding to decomposed color components of multicolor images, respectively.

The process unit 1Y includes a photoreceptor 2, a charging roller 3, a developing unit 4 and a cleaning blade 5. The photoconductor 2 is an image carrier, and the charging roller 3 is a charging mechanism to charge a surface of the photoconductor 2. The developing unit 4 is a developing mechanism to form a toner image on the surface of the photoconductor 2, and the cleaning blade 5 is a cleaning mechanism to clean the surface of the photoconductor 2.

Further, the image forming apparatus according to the present invention includes an exposure device 7, a recording medium supply unit 9, an intermediate transfer unit 8, and a fixing unit 6.

The exposure device 7 forms an electrostatic latent image on the surface of the photoconductor 2, and the recording medium supply unit 9 supplies recording media P, such as sheets of paper and overhead projector (OHP) sheets, stored in a sheet cassette 9A using a feed roller 9B. The intermediate transfer unit 8 transfers the image to the recording medium P, and the fixing unit 6 fixes an image on the recording medium P.

Further, the image forming apparatus includes a stock unit 10, a sheet material container 11, a sheet supply roller 30, a separation unit 12 and a sheet material collection unit 13.

The stock unit 10 stocks the recording medium P output outside the main body 100, and the sheet material container 11 serves as a cover sheet container and contains gloss assist sheets S (i.e., cover sheets). The sheet supply roller 30 supplies the gloss assist sheet S from the sheet material container 11 to the fixing unit 6. The separation unit 12 separates the gloss assist sheet S from the recording medium P, and the gloss assist sheet S separated from the recording medium P is collected in the sheet material collection unit 13.

In FIG. 1, paths indicated by arrows A, B and C in that order form a recording medium conveyance path R to convey the recording medium P from the recording medium supply unit 9 to the stock unit 10. Further, paths shown by arrows D and E in that order form a sheet material conveyance path to convey the gloss assist sheet S from the sheet material container 11 to the sheet material collection unit 13. A pair of registration rollers 22 is provided on a way of the recording medium conveyance path R between the recording medium supply unit 9 and a secondary transfer roller 18. A guide member 31 is disposed at a position where the sheet material conveyance path faces the sheet material supply roller 30 so as to guide the gloss assist sheet S.

The intermediate transfer unit 8 includes an intermediate transfer belt 16 formed of an endless belt stretched around a plurality of rollers 14 and 15. Four primary rollers 17 are disposed at respective positions facing the respective photoreceptors 2. The respective primary rollers 17 press against the inner surface of the intermediate transfer belt 16 to make primary transfer nips at positions where the respective primary rollers 17 are in contact with the intermediate transfer belt 16. Further, the secondary roller 18 is disposed at a position where the roller 14 faces the secondary roller 18. The secondary roller 18 presses against an outer surface of the intermediate transfer belt 16 to make a secondary transfer nip at a position at which the secondary roller 18 is in contact with the intermediate transfer belt 16. A belt cleaning device 19 is provided on an outer circumferential side of the intermediate transfer belt 16 to clean the surface of the intermediate transfer belt 16.

In the image forming apparatus of this embodiment, the gloss assist sheet S is formed of a thin film having 25 μm thickness including polyester (PET) as a base material because the material has a sufficient heat resistance and is hard to get fusion bond of toner. However, the material and the thickness of the gloss assist sheet S is not limited thereto.

The image forming apparatus according to the present embodiment includes a gloss level selector 102 for selecting the gloss level of output images. More specifically, users can select a high-gloss image mode or a low glossiness image mode by operating the gloss level selector 102 can be operated via an operation panel 101 provided on the main body 100 of the image forming apparatus or on a display of a personal computer (PC) connected to the image forming apparatus.

Referring to FIG. 1, a basic operation of the image forming apparatus mentioned above will be described below.

First, an operation in a case when the low glossiness image formation mode is selected is described.

When the image forming operation is started, the photoreceptor 2 of each process unit 1 is driven to rotate by a drive unit, not shown, in a clockwise direction in FIG. 1. The surface of each photoreceptor 2 is charged uniformly with a predetermined polarity. A laser beam is directed onto the surface of the photoconductor 2 to form an electrostatic latent image thereon based on the image data. The image data for each photoconductor 2 is the single color image data created by decomposing a multicolor image data into the respective data of the decomposed color components, yellow (Y), cyan (C), magenta (M), and black (B). Then, toner is supplied to the electrostatic latent image formed on the photoconductor 2 by the developing unit 4 to visualize the electrostatic latent image as a toner image.

When at least one of the rollers around which the intermediate transfer belt 16 is stretched is driven to rotate, the intermediate transfer belt 16 is driven to run in a direction shown by an arrow in FIG. 1. Further, a controlled potential to have a constant voltage or a constant electrical current with an opposite polarity to the charged toner is applied to the primary roller 17. Accordingly, a transfer field is formed in each primary transfer nip between the primary roller 17 and the photoreceptor 2. The single-color toner images formed on the photoreceptors 2 in the respective process units 1Y, 1C, 1M and 1B are transferred onto the intermediate transfer belt 16 by the transfer field formed at the respective nips and superimposed one on another thereon. Consequently, the intermediate transfer belt 16 holds a multicolor toner image on the surface of the intermediate transfer belt 16.

After transferring the image, residual toner adhering to and remaining on the surface of the photoreceptor 2 is removed by the cleaning blade 5. Then, any electrical charge remaining on the surface of the photoreceptor 2 is removed by a neutralization device, not shown, to initialize the surface potential of the photoreceptor 2 in preparation for the following image forming.

The recording medium P is fed into the recording medium conveyance path R from the recording medium supply unit 9 disposed at a lower part of the image forming apparatus. The fed recording medium P is sent to the secondary transfer nip formed between the secondary transfer roller 18 and the roller 14 that faces the secondary transfer roller 18 at a timing controlled by the registration roller 22. At this timing, a potential of the opposite polarity to that of the charged toner image on the intermediate transfer belt 16 is applied to the secondary transfer roller 18 so that a transfer field is formed in the secondary transfer nip. Accordingly, the toner image formed on the intermediate transfer belt 16 is transferred onto the recoding medium P collectively. The recoding medium P onto which the toner image is transferred is conveyed to the fixing unit 6. At the fixing unit 6, the toner is melted to fix the image by applying heat and pressure. The recording medium P having the fixed toner image is then output outside the image forming apparatus and is stocked in the stock unit 10.

Next, an operation in a case when the high-gloss image formation mode is selected is described below.

Similarly to the operation in the low glossiness image formation mode, after the toner image is transferred to the recording medium P, the recording medium P is sent to the fixing unit 6. However, in the high-gloss image formation mode, a gloss assist sheet S is also sent to the fixing unit 6 from the sheet material container 11. In the fixing unit 6, after the gloss assist sheet S is superimposed on the imaging surface of the recording medium P on which an unfixed image is formed (hereinafter "unfixed imaging surface"), the recording medium P and the gloss assist sheet S overlapping each other are heated and pressed so that the toner on the recording medium P is melt by heat to fix the image. After that, the recording medium P and the gloss assist sheet S overlapping each other are output from the fixing unit 6. Then, the gloss assist sheet S is separated from the recording medium P by the separation unit 12. Then, the recording medium P is output into the stock 10 and the gloss assist sheet S is output into the sheet material collector 13.

As described above, when the high-gloss image formation mode is selected, the image is fixed under the condition in which the gloss assist sheet S overlaps the unfixed imaging surface of the recording medium P. Accordingly, it is possible to form a smooth toner imaging surface, resulting in a high-gloss image. By contrast, when the low glossiness image formation mode is selected, the recording medium P is sent to the fixing unit 6 without supplying the gloss assist sheet S. Thus, by appropriately selecting the image mode, high-gloss image formation mode or low glossiness image formation mode, it is possible to minimize consumption of the gloss assist sheets S.

Although the description above concerns the basic operation of the image forming apparatus when a multicolor image is formed on the recording medium, it is possible to form a single color image using one of the four process units 1Y, 1C, 1M and 1B, or to form a bicolor or tricolor image using two or three process units 1 in the similar way.

Figure 2:
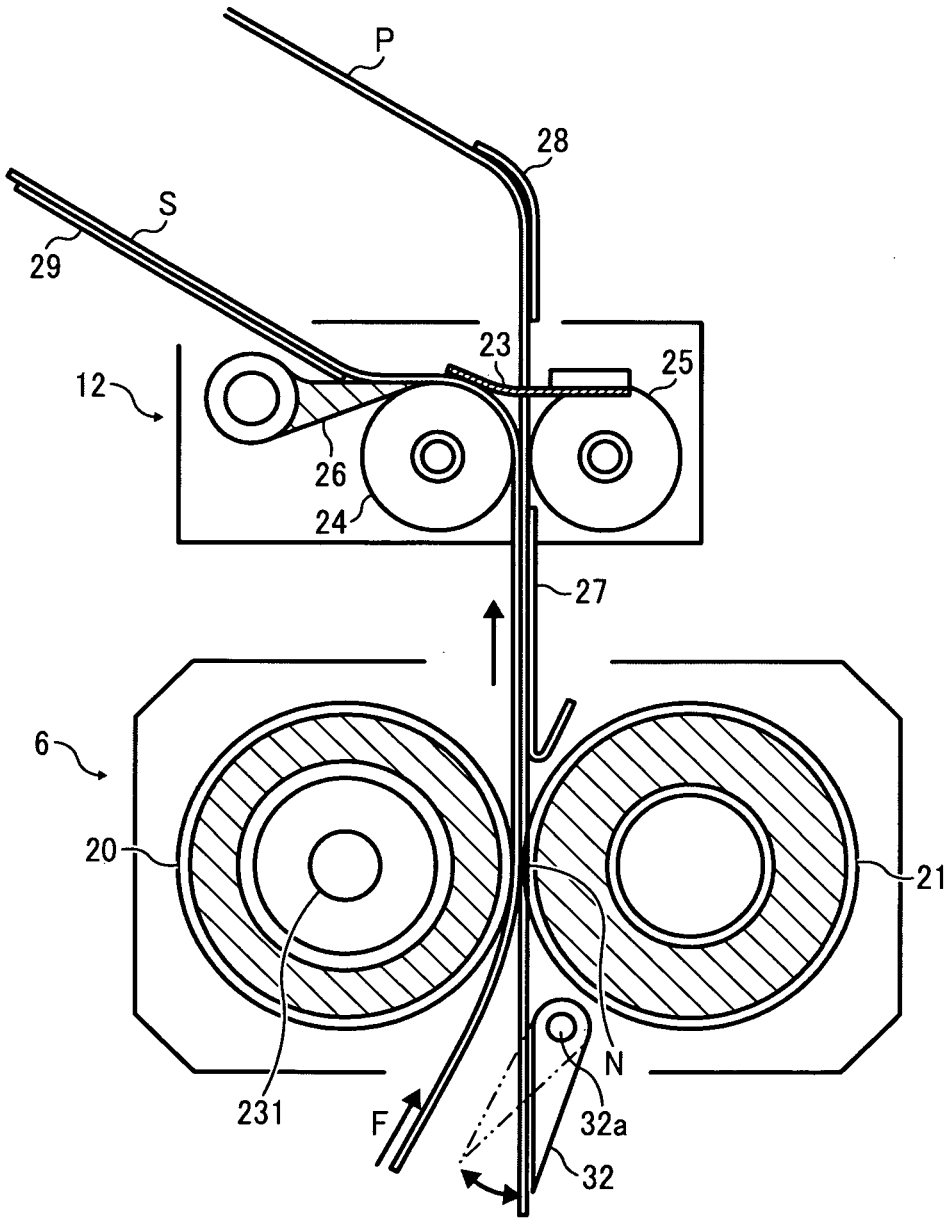
FIG. 2 is a schematic view of a fixing unit and a separation unit according to embodiments of the present invention.
Figure 3:
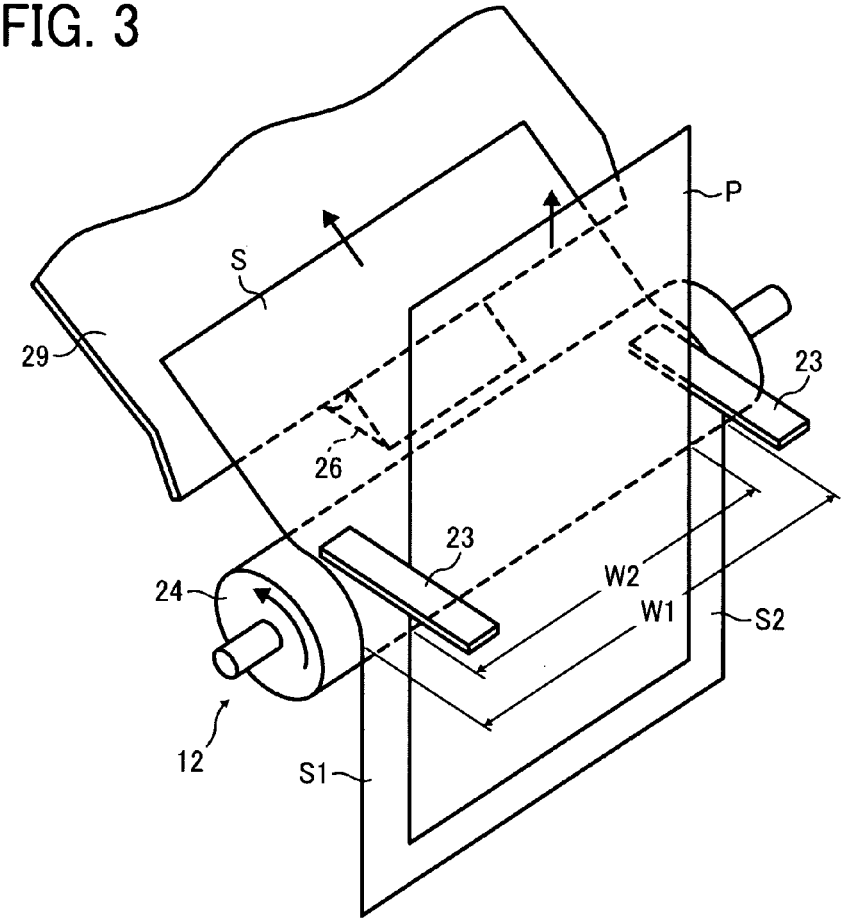
FIG. 3 is an oblique perspective view of a separation unit.

Referring to FIGS. 2 and 3, configurations of the fixing unit 6 and the separation unit 12 according to embodiments of the present invention will be described below.

FIG. 2 is a schematic view of the fixing unit 6 and the separation unit 12. FIG. 3 is an oblique perspective view of the separation unit 12.

As shown in FIG. 2, the fixing unit 6 includes a heat roller 20 and a pressure roller 21. The heat roller 20 is a rotary heating member, and the pressure roller 21 is a rotary pressure member. The heat roller 20 is formed of a cylindrical member and an elastic layer covering a surface of the cylindrical member. Further, the surface of the elastic layer is coated with a mold release layer. For the cylindrical member, it is preferable to use a metal such as aluminum that has an excellent mechanical strength and a fine thermal conductivity. However, the material of the cylindrical member is not limited to aluminum. Any other materials that have a sufficient mechanical strength and a good thermal conductivity, for example, metal such as stainless steel, steel, and brass, and alloys, are applicable to the material of the cylindrical member. As for the elastic layer, an elastic material such as silicon rubber that has an excellent heat resistance is used. However, any other materials which have a sufficient heat resistance, for example, fluorocarbon rubber, are applicable to the material of the elastic layer. A method to form the elastic layer onto the cylindrical member is not limited to a specific method, and, for example, injection molding methods and general coating methods can be used.

As for the material of the mold release layer, Perfluoroalkoxy (PFA) may be used. However, any other materials, for example, fluorocarbon rubber and fluorocarbon resin, that have a sufficient heat resistance and a good mold releasability against toner are applicable to the material of the mold release layer. Further, a halogen heater 231 is provided inside the heat roller 20, and a power supply for the halogen heater 231 is controlled so that a surface temperature of the heat roller 20 becomes a predetermined target temperature (a fixing temperature).

Similarly to the heat roller 20, the pressure roller 21 is formed of a cylindrical member made of metal such as aluminum and an elastic layer such as silicon rubber covering a surface of the cylindrical member. Further, the surface of the elastic layer is coated with a mold release layer such as PFA. The pressure roller 21 is biased to the heat roller 20 by a biasing member (not shown) such as a pressure spring. Accordingly, the pressure roller 21 is pressed against the heat roller 20 by the bias force, and a fixing nip N is formed at the position where the pressure roller 21 presses against the heat roller 20.

It is to be noted that the fixing unit 6 according to the embodiment is not limited to the configuration described above. For example, a pair of endless belts may be employed as a pair of fixing members replacing the heat roller 20 and the pressure roller 21, and the endless belts may be pressed by rollers or pads to press against each other. Alternatively, a configuration in which an endless belt presses against a roller may be used. Yet alternatively, it may be possible to employ other types of fixing members. The fixing members are not limited those pressing against each other but may be only in contact with each other without being pressed.

As shown in FIGS. 2 and 3, the separation unit 12 includes a pair of separation blades 23, a guide roller 24, a press roller 25 and a peeling member 26. The separation blades 23 serve as first separators to separate the gloss assist sheet S from the recording medium P after the fixing process, and the guide roller 24 is a guide member to guide the separated gloss assist sheet S. The press roller 25 is pressed against the guide roller 24. The peeling member 26 peels the gloss assist sheet S from the guide roller 24 and thus serves as a second separator for separating the gloss assist sheet S from the guide roller 24. It is to be noted that the press roller 25 is omitted in FIG. 3.

Further, in FIG. 2, guide members 27 and 28 for guiding the recording medium P are disposed at an upstream side and a downstream side of the separation unit 12 in a direction in which the recording medium P is transported (hereinafter "recording medium conveyance direction"). A member given reference number 29 in FIG. 2 is a guide member to guide the gloss assist sheet S separated from the recording medium P to the sheet material collection unit 13.

The pair of separation blades 23 is formed of a pair of elastic members. For example, the elastic members may be plastic members or thin metal plates. A first end portion (base part) of the separation blades 23 is fixed to a frame of the main body 100 of the image forming apparatus or the like. Further, a second end portion (top portion) of the separation blades 23 presses against an outer surface of the guide roller 24 with a predetermined pressure force.

As shown in FIG. 3, the pair of separation blades 23 is provided so as to touch the gloss assist sheet S but not to touch the recording medium P. More specifically, a width W1, that is, a length in a direction (width direction) perpendicular to the recording medium conveyance direction, of the gloss assist sheet S is larger than a width W2 of the recording medium P. Accordingly, the separation blades 23 respectively come in contact with both edge portions S1 and S2 of the gloss assist sheet S jutting from the recording medium P in the width direction when the gloss assist sheet S overlaps the recording medium P. It is to be noted that when a plurality of different sheet widths are used, the gloss assist sheet S should have a width larger than the largest sheet width.

In this embodiment, the guide roller 24 and the press roller 25 in the separation unit 12, and the heat roller 20 and the pressure roller 21 in the fixing unit 6 are configured to rotate in both directions, i.e., in a normal rotation direction and a reverse rotation direction. In this specification, the rotation direction identical to the direction indicated by arrow F in FIG. 2, in which the sheet supply roller 30 feeds the gloss assist sheet S (hereinafter "supply direction shown), is defined as the normal rotation direction. Further, the rotation direction opposite to the supply direction in which the gloss assist sheet S is conveyed is defined as the reverse rotation direction. In other words, the guide roller 24, the press roller 25, the heat roller 20, the pressure roller 21, and a drive unit 33 (shown in FIG. 5) together form a sheet return mechanism to convey the gloss assist sheet S in the reverse direction to the supply direction by rotating reversely. In the configuration shown in FIG. 5, the drive unit 33 is connected to the guide roller 24 and a controller 103 of the image forming apparatus. The controller 103 may be a computer including a central processing unit (CPU) and a memory. The computer performs various types of control processing according to programs stored in the memory as functions of the controller 103.

To switch the rotation direction of the rollers in the separation unit 12 and the fixing unit 6, the drive unit 33 is capable of switching the rotation direction of at least one of each pair of rollers pressing against each other.

Further, the gloss assist sheet S is returned to a predetermined position from which the gloss assist sheet S can be supplied again by the sheet supply roller 30 (hereinafter also "supply position").

In FIG. 2, on an upstream side of the fixing nip N in the recording medium conveyance direction (in a lower part in FIG. 2), a return guide 32 is provided to prevent the gloss assist sheet S from entering the recording medium conveyance path R (shown in FIG. 1) when the gloss assist sheet S is being returned. The return guide 32 is provided rotatably or pivotally about a shaft 32*a* to switch between two positions, a first position indicated by solid line in FIG. 2, at which the side of the return guide 32 is closer to the recording medium conveyance path R is substantially in parallel to the recording medium conveyance path R, and a second position indicated by broken lines in FIG. 2, at which the return guide 32 crosses the recording medium conveyance path R.

An operation of the fixing unit 6 and the separation unit 12 according to the embodiment is now described.

Figure 4:
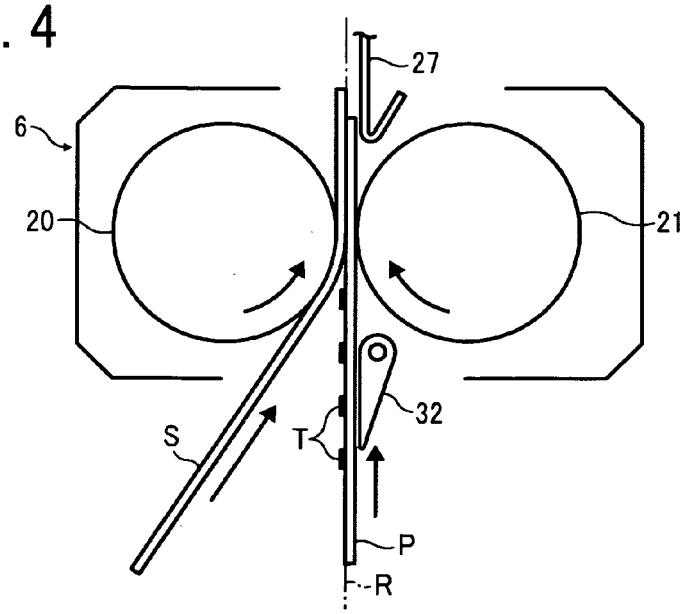
FIG. 4 is a schematic view illustrating a fixing operation of the fixing unit.

As described above, in the high-gloss image formation mode, when the recording medium P is supplied to the fixing unit 6, the gloss assist sheet S is also supplied to the fixing unit 6 at the same time. As shown in FIG. 4, the return guide 32 is provided along the recording medium conveyance path R to allow the recording medium P to enter the recording medium conveyance path R. Further, in this embodiment, it is controlled so that the gloss assist sheet S enters the fixing unit 6 slightly earlier than the recording medium P. Then, the recording medium P and the gloss assist sheet S are conveyed while being heated and pressed by the heat roller 20 and the pressure roller 21 that rotate in the normal rotation direction with the gloss assist sheet overlapping the imaging surface of the recording medium P carrying an unfixed image (toner image) T. Accordingly, heat of the heat roller 20 is transmitted to the unfixed image T through the gloss assist sheet S so that the toner is melted to fix the toner image T on the recording medium P. Then, the recording medium P and the gloss assist sheet S overlapping each other are output from the fixing unit 6 and are conveyed to the separation unit 12.

Figure 5:
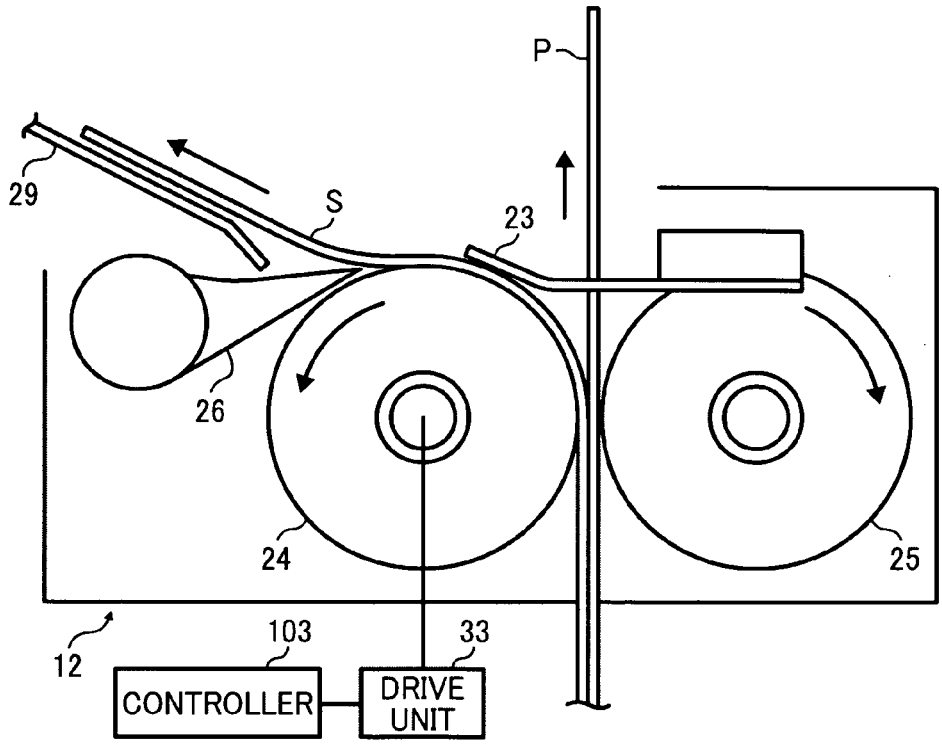
FIG. 5 is a schematic view illustrating a separation operation of the separation unit.

As shown in FIG. 5, in the separation unit 12, the recording medium P and the gloss assist sheet S are conveyed by the guide roller 24 and the press roller 25 that rotate in the normal rotation direction. Since the pair of separation blades 23 are in contact with the end portions of the gloss assist sheet S jutting from the recording medium P in the width direction, the gloss assist sheet S is pressed to the guide roller 24 and the gloss assist sheet S is separated from the recording medium P. On the other hand, the recording medium P is conveyed without touching the separation blades 23.

The separated gloss assist sheet S is pressed against the outer surface of the guide roller 24 by the separation blades 23 and then is conveyed by the guide roller 24 that rotates in the normal rotation direction. When a leading edge portion of the gloss assist sheet S arrives at a position where the peeling member 26 is provided, the peeling member 26 enters a gap between the leading edge portion of the gloss assist sheet S and the outer circumferential surface of the guide roller 24 so that the gloss assist sheet S is peeled off the guide roller 24. The gloss assist sheet S peeled off from the guide roller 24 is conveyed to the sheet material collection unit 13 (refer to FIG. 1) along the guide member 29. Further, the recording medium P separated from the gloss assist sheet S is output to the stock unit 10 (refer to FIG. 1).

Figure 6:
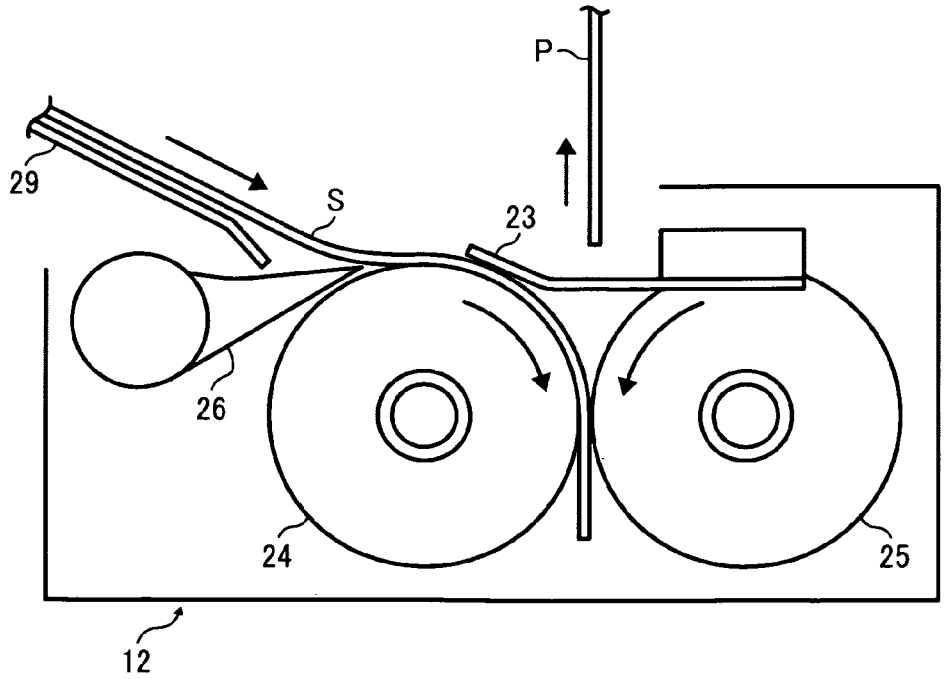
FIG. 6 is a schematic view illustrating a return operation of the separation unit.

When the gloss assist sheet S is conveyed reversely and returned to the predetermined position (supply position), the guide roller 24 and the press roller 25 are rotated reversely after separation of the gloss assist sheet S from the recording medium P as shown in FIG. 6. Accordingly, the gloss assist sheet S is conveyed in the reverse direction to the supply direction of the gloss assist sheet S and is conveyed to the fixing unit 6. In this process, the recording medium P is not conveyed reversely. More specifically, the reverse rotation of the guide roller 24 and the press roller 25 is performed under a condition in which the recording medium P has been passed the nip between the guide roller 24 and the press roller 25 and the gloss assist sheet S is still captured by the nip between the guide roller 24 and the press roller 25. For this reason, a length of the gloss assist sheet S in the conveyance direction is made longer than the length of the recording medium P in the recording medium conveyance direction.

Figure 7:
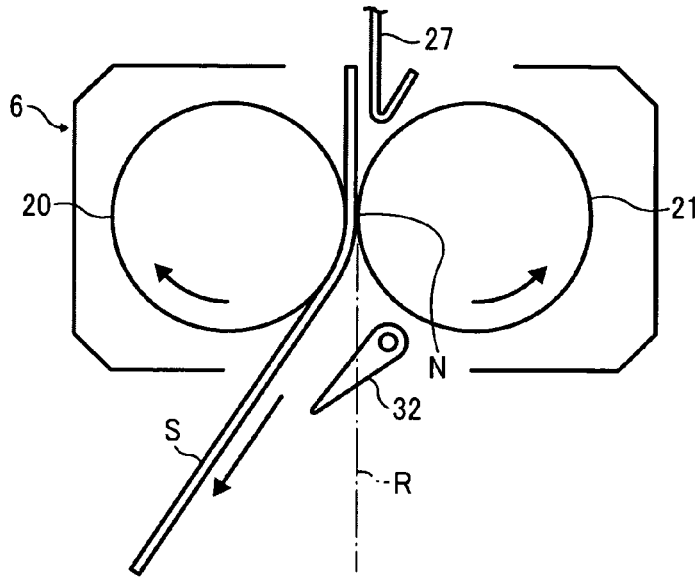
FIG. 7 is a schematic view illustrating the return operation of the fixing unit.

Subsequently, as shown in FIG. 7, in the fixing unit 6, the heat roller 20 and the pressure roller 21 are rotated reversely to convey the gloss assist sheet S conveyed from the separation unit 12 in the reverse direction opposite to the supply direction of the gloss assist sheet S. At this time, the return guide 32 is set to cross the recording medium conveyance path R. Accordingly, the gloss assist sheet S conveyed reversely is guided not to enter the recording medium conveyance path R. Further, the gloss assist sheet S is conveyed to a side of the sheet supply roller 30 (shown in FIG. 1) and is returned to the predetermined position so that the gloss assist sheet S can be supplied again by the sheet supply roller 30. More specifically, the gloss assist sheet S is returned to the predetermined position at which the leading edge of the gloss assist sheet S in the supply direction is positioned at least on an upstream side of the fixing nip N and the rear edge of the gloss assist sheet S in the supply direction is positioned at least at the sheet supply roller 30.

In this embodiment, the length of the gloss assist sheet S in the conveyance direction is made longer than a length of a portion of the sheet material conveyance path from the guide roller 24 (or the press roller 25) to the heat roller 20 (or the pressure roller 21) so as to convey the gloss assist sheet S from the separation unit 12 to the fixing unit 6 reliably. Further, it is preferable to set the length of the gloss assist sheet S in the conveyance direction longer than the length of a portion of the sheet material conveyance path from the nip between the guide roller 24 and the press roller 25 to the fixing nip N between the heat roller 20 and the pressure roller 21 so that the gloss assist sheet S is conveyed reversely more reliably.

As described above, since the gloss assist sheet S is returned after separation process, it becomes possible to supply the single, identical gloss assist sheet S again by rotating the sheet supply roller 30 when the subsequent recording medium P is supplied to the fixing unit 6. In this embodiment, when a plurality of recording media are supplied to the fixing nip successively in one printing job cycle in the high-gloss image formation mode, the single gloss assist sheet S is returned repeatedly to the supply position for each recording medium P until the completion of fixing process for the last recording medium. After the image is fixed on the last recording medium, the separated gloss assist sheet S is output to the sheet material collection unit 13.

Accordingly, it is possible to reduce a number of times the gloss assist sheet S is returned from the sheet material collection unit 13 to the sheet material container 11 in particular, in the successive image forming which uses the gloss assist sheet S frequently. By contrast, because the gloss assist sheet S is used only once in the image forming in which only a single recording medium is fixed in one printing job in the high-gloss image formation mode, in this embodiment, the gloss assist sheet S is not returned after the separation process, but may be output directly to the sheet material collection unit 13.

Alternatively, the gloss assist sheet S may be returned even in the image forming operation in which only a single recording medium is fixed in one printing job. In such a case, the gloss assist sheet S returned will be used later when subsequent high-gloss image forming is performed.

Additionally, in the separation unit 12 in this embodiment, the separation blades 23 are provided not to touch the recording medium P when the gloss assist sheet S is being peeled off from the recording medium P. Accordingly, there is no possibility of making a touching trace of the separation blades 23 on the imaging surface of the recording medium P, and thus fine images can be produced. Further, since the separation blades 23 are formed of elastic material, it is possible to reduce damage to the gloss assist sheet S such as scratches on the gloss assist sheet S. Accordingly, it is possible to extend the useful life of the gloss assist sheet S, which is particularly preferable when the gloss assist sheet S is used repeatedly.

Further, although the gloss assist sheet S can be peeled by a single separation blade 23 from the guide roller 24, in this embodiment, a pair of separation blades 23 is provided to touch the both edge portions of the gloss assist sheet S so that it becomes possible to convey the gloss assist sheet S stably while peeling the gloss assist sheet S from the guide roller 24. Further, because the separation blades 23 press the separated gloss assist sheet S to the guide roller 24, it is possible to give a conveyance force of the guide roller 24 to the gloss assist sheet S reliably. It is to be noted that, even when the separation blades 23 do not give a pressure force to the gloss assist sheet but just touch it, or the separation blades 23 is provided separately from the guide roller 24, it may be possible to peel the gloss assist sheet S off.

Additionally, since the peeling member 26 is provided in this embodiment, even if the strength of adherence between the gloss assist sheet S and the guide roller 24 is increased by pressing the guide roller 24 to the gloss assist sheet S, the gloss assist sheet S can still be peeled off the guide roller 24 reliably. Further, using the peeling member 26 makes it possible to peel the gloss assist sheet S off the guide roller 24 at a predetermined position, thus enabling reliable conveyance of the gloss assist sheet S after peeling. Further, a guide surface (outer circumferential surface) of the guide roller 24 is shaped to have an outwardly convex, curved surface, thus facilitating easy separation of the gloss assist sheet S therefrom.

A guide member which does not rotate, for example, a guide plate, can guide the gloss assist sheet S replacing the guide roller 24. However, when the guide roller 24 which rotates is used, there is an advantage to convey the gloss assist sheet S smoothly. As for the guide member, an endless belt (guide belt) which runs around may be applicable besides the guide roller 24.

Further, it is preferable to form a guide surface to have a convex curve so as to peel the gloss assist sheet S off from the guide belt or the guide plate easily.

Figure 8:
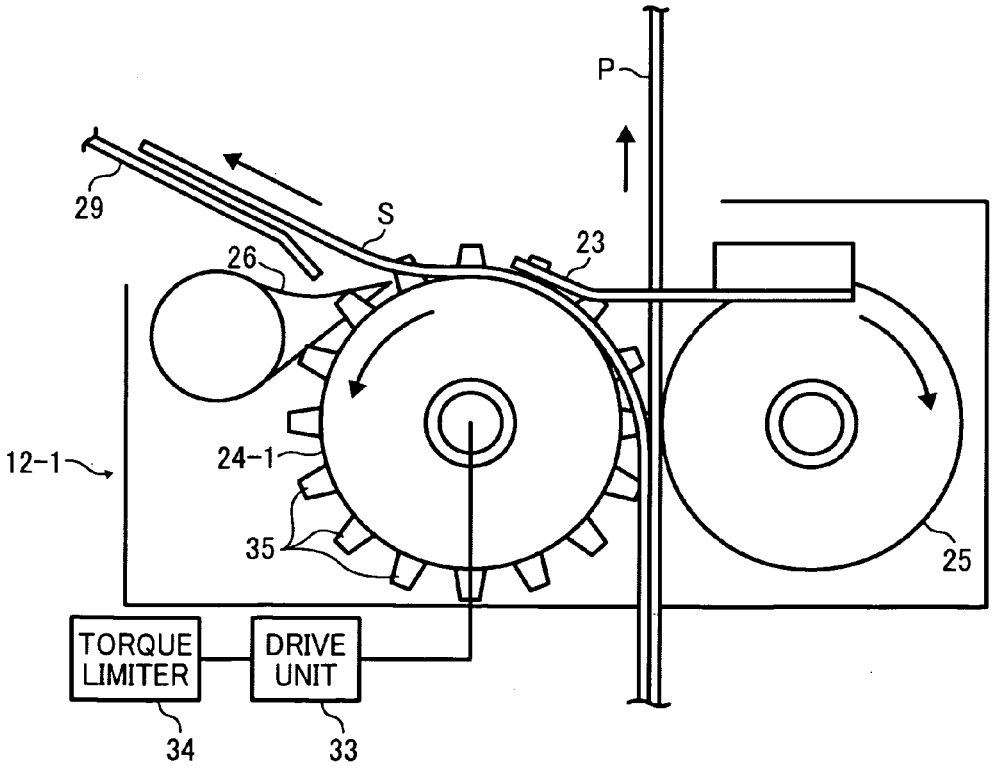
FIG. 8 is a schematic view of another embodiment of the separation unit.
Figure 9:
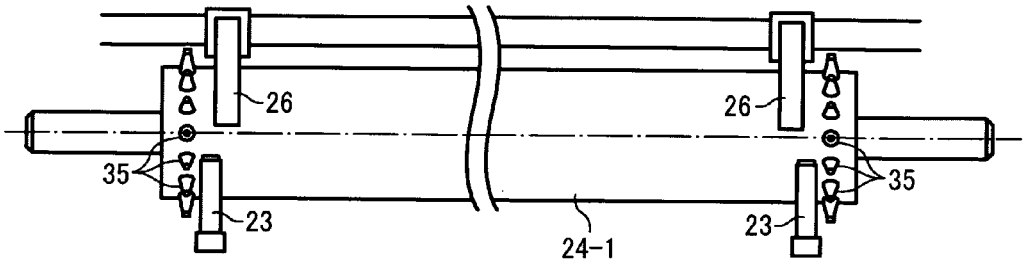
FIG. 9 is a schematic view of a guide roller and associated members of the another embodiment of the separation unit.

Referring to FIGS. 8 and 9, another embodiment of the present invention will be described.

FIG. 8 is a schematic view of a separation unit 12-1 according to another embodiment.

Figure 10:
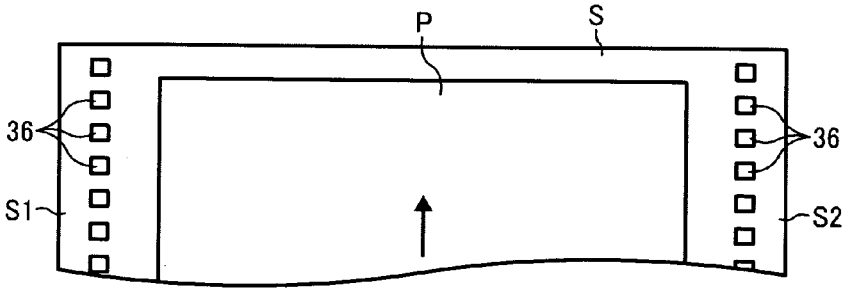
FIG. 10 is a plan view of a gloss assist sheet used for the another embodiment of the separation unit.

FIG. 9 is a schematic view of a guide roller 24-1 and the associated members of the separation unit 12-1 according to another embodiment. FIG. 10 is a plan view of a gloss assist sheet used in another embodiment.

The separation unit 12-1 shown in FIG. 8 includes a torque limiter 34 for a drive unit 33 that drives the guide roller 24-1 to rotate. In this embodiment, a rotation velocity of the guide roller 24-1 is set so that a conveyance velocity for the gloss assist sheet S by the guide roller 24-1 is faster than a conveyance velocity by the fixing unit 6.

Additionally, as shown in FIGS. 8 and 9, a plurality of projections 35 is provided on an outer surface of the guide roller 24-1 at predetermined intervals (i.e., a predetermined pitch) in a circumferential direction thereof. The plurality of projections 35 is provided on both end portions of the guide rollers 24-1 in the width direction. Further, as shown in FIG. 10, a plurality of holes 36 are formed in the end portions or jutting portions S1 and S2 of the gloss assist sheet S jutting from the recording medium P in the width direction, arranged at a predetermined pitch in a longitudinal direction (conveyance direction). These holes 36 are provided at predetermined positions corresponding to the respective projections 35 to engage with the respective projections 35. In this embodiment, the projection 35 is tapered toward the top portion of the projection 35 so that the projection 35 can engage with the hole 36 easily. However, the shapes of the projection 35 and the hole 36 are not limited to the shapes shown in FIGS. 8 and 9. Further, in this embodiment, a peeling member 26 is provided in each end portion of the guide rollers 24-1.

Referring to FIGS. 8, 9 and 10, a separation operation of the separation unit 12-1 is described below.

As shown in FIG. 8, the gloss assist sheet S separated from the recording medium P by the separation blade 23 is pressed to the guide roller 24-1 that is driven to rotate by the drive unit 33. Accordingly, the projection 35 formed on the guide roller 24-1 engages with the hole 36 formed in the gloss assist sheet S so that the gloss assist sheet S is held on the guide roller 24-1 (refer to FIG. 10). Then, the gloss assist sheet S is conveyed by the normal rotation of the guide roller 24 under while being held on the guide roller 24-1.

Additionally, in this embodiment, the conveyance velocity of the guide roller 24-1 is faster than the conveyance velocity of the fixing unit 6. Accordingly, the gloss assist sheet S held on the guide roller 24-1 is kept taut by the difference between these conveyance velocities. When the tension is increased and accordingly a rotation torque that causes the guide roller 24-1 (or drive unit 33) to rotate exceeds a predetermined reference torque, the torque limiter 34 starts to work so that the conveyance velocity of the guide roller 24-1 is synchronized with the conveyance velocity of the fixing unit 6 to convey the gloss assist sheet S with a predetermined tension.

After that, the gloss assist sheet S being conveyed by the guide roller 24-1 is separated from the guide roller 24-1 by the peeling member 26. Accordingly, the projection 35 of the guide roller 24-1 is disengaged from the hole 36 formed in the gloss assist sheet S, and thus engagement between the gloss assist sheet S and the guide roller 24-1 is released. Then, the separated gloss assist sheet S is conveyed to the sheet material collection unit 13 (refer to FIG. 1).

As described above, in the embodiment, when the gloss assist sheet S is conveyed by the guide roller 24-1, the projections 35 engage with the respective holes 36 of the gloss assist sheet S. Accordingly, the gloss assist sheet S does not slip on the guide roller 24-1, thus enabling reliable conveyance of the gloss assist sheet S. Further, the gloss assist sheet S can wind around the guide roller 24-1 and contact the guide roller 24-1 closely, resulting in easy release of the gloss assist sheet S from the recording medium P. Further, since the gloss assist sheet S is pressed to the guide roller 24-1 by the separation blades 23, the projection 35 can engage with the hole 36 easily and prevent the projection 35 from dropping off from the hole 36 simultaneously.

Further, in this embodiment, since the gloss assist sheet S being transported is at a predetermined tension by the guide roller 24-1, the gloss assist sheet S can be prevented from going slack, thus providing smooth conveyance of the gloss assist sheet S. Keeping the gloss assist sheet S taut also facilitates winding the gloss assist sheet S around the guide roller 24-1, that is, facilitates close contact between the gloss assist sheet S and the guide roller 24-1, and consequently facilitating separation of the gloss assist sheet S from the recording medium P.

It is to be noted that other portions of the separation unit 12-1 according to the present embodiment except the portions described above have configurations and attain effects similar to those of the previous embodiment shown in FIGS. 2 through 7, and thus descriptions thereof are omitted.

A variation of the above-described guide roller 24-1 that includes the projections 35 is described below with reference to FIG. 11.

Figure 11:
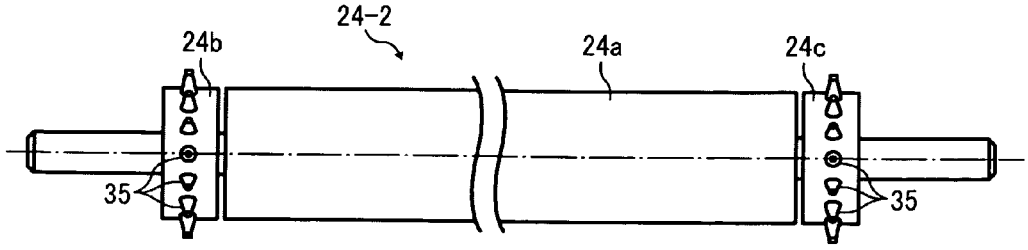
FIG. 11 illustrates a modification of a guide roller related to the another embodiment of the separation unit.

A guide roller 24-2 shown in FIG. 11 include a guide member 24*a* and separate engagement members 24*b* and 24*c* that respectively include multiple projections 35 and are provided separately from the guide member 24*a*. Dividing the guide roller 24 into the guide member 24*a* and the separate engagement members 24*b* and 24*c* as in the guide roller 24-2 shown in FIG. 11 can eliminate or reduce difficulties in manufacturing of the guide roller 24 and increase the number of selectable manufacturing methods. The guide member 24*a* may be made of a different material from that of the separate engagement members 24*b* and 24*c* each of which includes the projections 35.

Figure 12A:
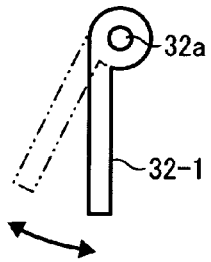
FIG. 12A is a side view of a return guide roller according to the present invention.
Figure 12B:
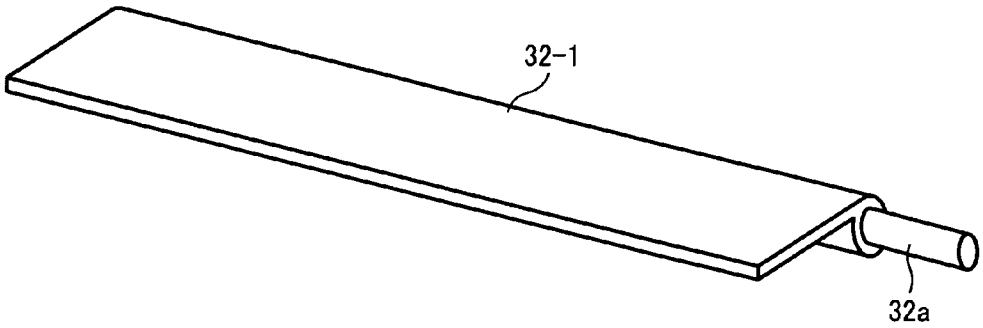
FIG. 12B is an oblique perspective view of the return guide roller according to the present invention.

FIGS. 12A and 12B illustrate a variation of the return guide 32. FIG. 12A is a side view of a return guide 32-1, and FIG. 12B is an oblique perspective view of the return guide 32-1.

Although, in the above-described embodiment, the return guide 32 shown in FIG. 2 has a sphenoidal or wedge shape, that is, the return guide 32 becomes thinner gradually towards the top portion thereof in cross section, the return guide 32-1 shown in FIGS. 12A and 12B is formed using a straight plate having a uniform thickness. However, the return guide 32 may be bent in conformity with the sheet material conveyance path.

Although In the embodiment described above, the heat roller 20 and the pressure roller 21 in the fixing unit 6 and the guide roller 24 and the press roller 25 in the separation unit 12 are used as rotary return members to convey the gloss assist sheet S reversely to the supply position, other rollers may be employed as the rotary return members. Using the heat roller 20 and the pressure roller 21 in the fixing unit 6 and the guide roller 24 and the press roller 25 in the separation unit 12 also as the rotary return members to convey the gloss assist sheet S reversely is advantageous in that the size as well as the cost of the devices can be reduced. The configuration of this embodiment can be applied not only to the color image forming apparatus shown in FIG. 1 but also to a variety of image forming apparatuses such as monochrome image forming apparatuses, copiers, printers, facsimiles, and multifunction apparatuses capable of two or more of there capabilities.

As described above, according to the embodiments, with a relatively compact and simple configuration, it is possible to return the sheet material (gloss assist sheet) separated from the recording medium automatically and use a single sheet material repeatedly. Accordingly, it is possible to reduce the number of times the user sets or loads the sheet material, for example, in the sheet material container 11, thus enhancing convenience for the user. In particular, when a plurality of high-gloss images are printed successively, image formation can be accelerated by reducing the number of times of loading of the gloss assist sheet.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a first pair of rotary members disposed in a conveyance path through which a recording medium is transported, the first pair of rotary members pressing against each other and forming a first nip therebetween;

a cover sheet supply unit to transport a cover sheet from a supply position to the first nip, between an imaging surface of a recording medium and one of the rotary members, the cover sheet temporarily superimposed on the imaging surface of the recording medium;

a separation unit to separate the cover sheet from the recording medium after the recording medium passes through the first nip, disposed downstream from the first nip in a supply direction in which the cover sheet is supplied from the supply position, the separation unit including a second pair of rotary members pressing against each other and forming a second nip therebetween and a first separator for separating the cover sheet from the recording medium having an end portion pressed against an axial end portion of one of the second pair of rotary members; and a drive unit to rotate the first pair of rotary members and the second pair of rotary members in both a normal direction for transporting the cover sheet in the supply direction and a reverse direction reverse to the normal direction, the first pair of rotary members, the second pair of rotary members, and the drive unit together forming a cover sheet return mechanism for returning the cover sheet separated from the recording medium to the supply position.

2. The image forming apparatus of claim 1, further comprising:

a return guide disposed upstream from the first nip in the supply direction, to prevent the cover sheet from entering the conveyance path when the cover sheet is returned to the supply position.

3. The image forming apparatus of claim 1, wherein the first separator is configured to provide a pressing force against only the cover sheet.

4. The image forming apparatus of claim 1, wherein the first pair of rotary members is a pair of fixing members of a fixing unit that fixes the image on the recording medium, and the first nip is a fixing nip in which the image is fixed on the recording medium.

5. The image forming apparatus of claim 4, wherein when a plurality of recording media is supplied to the fixing nip successively, the cover sheet is returned to the supply position repeatedly for each recording medium until fixing of images on all of the plurality of recording media is completed.

6. The image forming apparatus of claim 4, further comprising a gloss level selector that enables a user to select whether to supply the cover sheet to the fixing nip when the recoding medium is supplied to the fixing nip.

7. The image forming apparatus of claim 4, wherein the cover sheet is a gloss assist sheet for enhancing a gloss level of the image formed on the recording medium.

8. The image forming apparatus of claim 1, wherein the second pair of rotary members is a guide roller to guide the cover sheet separated from the recording medium and a conveyance roller pressed against the guide roller.

9. The image forming apparatus of claim 8, wherein the first pair of rotary members is a pair of fixing members of a fixing unit that fixes the image on the recording medium, the first nip is a fixing nip in which the image is fixed on the recording medium, and a length of the cover sheet in the supply direction is longer than a distance from the fixing nip to the second nip formed between the guide roller and the conveyance roller.

10. The image forming apparatus of claim 8, wherein the has an end portion pressed against an outer circumferential surface of the guide roller, the first separator is positioned in the axial end portion of the guide roller in an axial direction thereof perpendicular to the supply direction, and a width of the cover sheet is greater than a width of the recording medium so that the first separator does not contact the recording medium.

11. The image forming apparatus of claim 10, wherein the first separator comprises an elastic separation blade.

12. The image forming apparatus of claim 8, wherein the separation unit comprises a second separator that includes a tapered end portion disposed adjacent to the guide roller and, in operation, introduced into a gap between a leading edge portion of the cover sheet and an outer circumferential surface of the guide roller to peel the cover sheet off the guide roller.

13. The image forming apparatus of claim 12, wherein the guide roller comprises multiple projections provided on an outer circumferential surface of the axial end portion of the guide roller at a predetermined pitch in a circumferential direction of the guide roller, and the multiple projections of the guide roller engaging multiple holes formed in a lateral side end portion of the cover sheet.

* * * * *